United States Patent [19]

Lombardo et al.

[11] 4,365,147

[45] Dec. 21, 1982

[54] ROTARY DRIVE ANTI-OVERTRAVEL DEVICE

[75] Inventors: Phillip J. Lombardo, Simsbury; Bruno S. Smilgys, Hartford, both of Conn.

[73] Assignee: Veeder Root Industries, Inc., Hartford, Conn.

[21] Appl. No.: 309,819

[22] Filed: Oct. 8, 1981

[51] Int. Cl.[3] ..... G06C 25/00

[52] U.S. Cl. ..... 235/131 R; 235/94 R; 74/440

[58] Field of Search ... 235/61 L, 61 M, 131 R–131 JA, 235/91 R, 94 R–94 A; 74/152, 440

[56] References Cited

U.S. PATENT DOCUMENTS

| | | | |
|---|---|---|---|
| 2,814,444 | 11/1957 | Bliss | 235/94 R |
| 3,251,544 | 5/1966 | Pilz et al. | 235/91 R |
| 3,413,867 | 12/1968 | Hamlin | 235/94 R |
| 3,847,347 | 11/1974 | Smilgys | 235/131 R |

*Primary Examiner*—Benjamin R. Fuller

*Attorney, Agent, or Firm*—Prutzman, Kalb, Chilton & Alix

[57] ABSTRACT

Two embodiments of a fuel pump cost counter anti-overtravel device having a controlled coil spring clutch for selectively clutching the cost counter drive train to a fixed drum for preventing cost counter overtravel at the termination of a fuel delivery.

13 Claims, 3 Drawing Figures

ROTARY DRIVE ANTI-OVERTRAVEL DEVICE

TECHNICAL FIELD AND BACKGROUND ART

The present invention relates generally to rotary drive anti-overtravel devices and more particularly to a new and improved rotary drive anti-overtravel device having notable application with a rotary counter drive train for preventing inertia and/or manual overtravel of the rotary counter and resulting count inaccuracy at the end of a count.

The conventional mechanical computer employed in gasoline dispensing apparatus incorporates a mechanical register having a pair of rotary counters on each of two opposite faces of the register for registering, on each of the two opposite faces, the cost and volume amounts of fuel delivered. Such a register is shown and described in U.S. Pat. No. 2,814,444 of Harvey N. Bliss, dated Nov. 26, 1957 and entitled "Register". The gasoline pump computer also conventionally incorporates a mechanical price variator of the type shown and described in U.S. Pat. No. 3,413,867 of Richard B. Hamlin, dated Dec. 3, 1968 and entitled "Variator", for establishing and posting the unit volume price of fuel. The variator has a center shaft connected for being mechanically driven by a gasoline meter, and the variator center shaft is connected for driving the volume counters of the register for registering the volume amount of fuel delivered. The price variator has settable gearing for establishing the unit volume price of fuel, and the output of the settable gearing is connected for driving the cost counters of the register for registering the cost amount of fuel delivered in accordance with the volume amount of fuel delivered and the unit volume price established by the setting of the variator gearing.

Because of the rapidly increasing price of gasoline and the concomitant higher drive ratio setting of the variator gearing, the cost counters are rotated at a substantially higher rate for any given volume rate of delivery of gasoline and whereby inertia overtravel of the high speed cost counters, resulting in an inaccurately high cost counter reading, is increasingly more likely to occur at the end of a fuel delivery.

In the past, anti-backlash devices (of the type shown and described in Pilz et al. U.S. Pat. No. 3,251,544, dated May 17, 1966 and entitled "Gear Train Control Arrangement" and in Smilgys U.S. Pat. No. 3,847,347, dated Nov. 12, 1974 and entitled "Rotary Drive Anti-Backlash Device") have been employed in the cost and volume counter drive trains of a fuel pump register for biasing the rotary drive trains in the reverse angular direction and thereby for resisting inertia overtravel of the drive trains and/or removing any overtravel if it occurs. However, the reverse bias provided by such anti-backlash devices adds a significant and undesirable additional load and whereby such anti-backlash devices have significant disadvantages in some fuel pump applications and in other applications where the resultant required drive torque is excessive.

DISCLOSURE OF THE INVENTION

It is a principal aim of the present invention to provide a new and improved rotary drive anti-overtravel device for a conventional fuel pump register for preventing inertia overtravel and resulting count inaccuracy of the usual cost and/or volume counters of the register at the cessation of a fuel delivery.

It is another aim of the present invention to provide a new and improved rotary drive anti-overtravel device having an overtravel brake of economical design for preventing overtravel of the rotary drive output.

It is a further aim of the present invention to provide a new and improved rotary drive anti-overtravel device of the type described which adds very little load or resistance to the normal operation of the rotary drive.

It is another aim of the present invention to provide a new and improved rotary drive anti-overtravel device of the type described providing reliable operation over a long useful life.

Other objects will be in part obvious and in part pointed out more in detail hereinafter.

A better understanding of the invention will be obtained from the following detailed description and the accompanying drawings of illustrative applications of the invention.

BEST MODE FOR CARRYING OUT THE INVENTION

Figure 1:
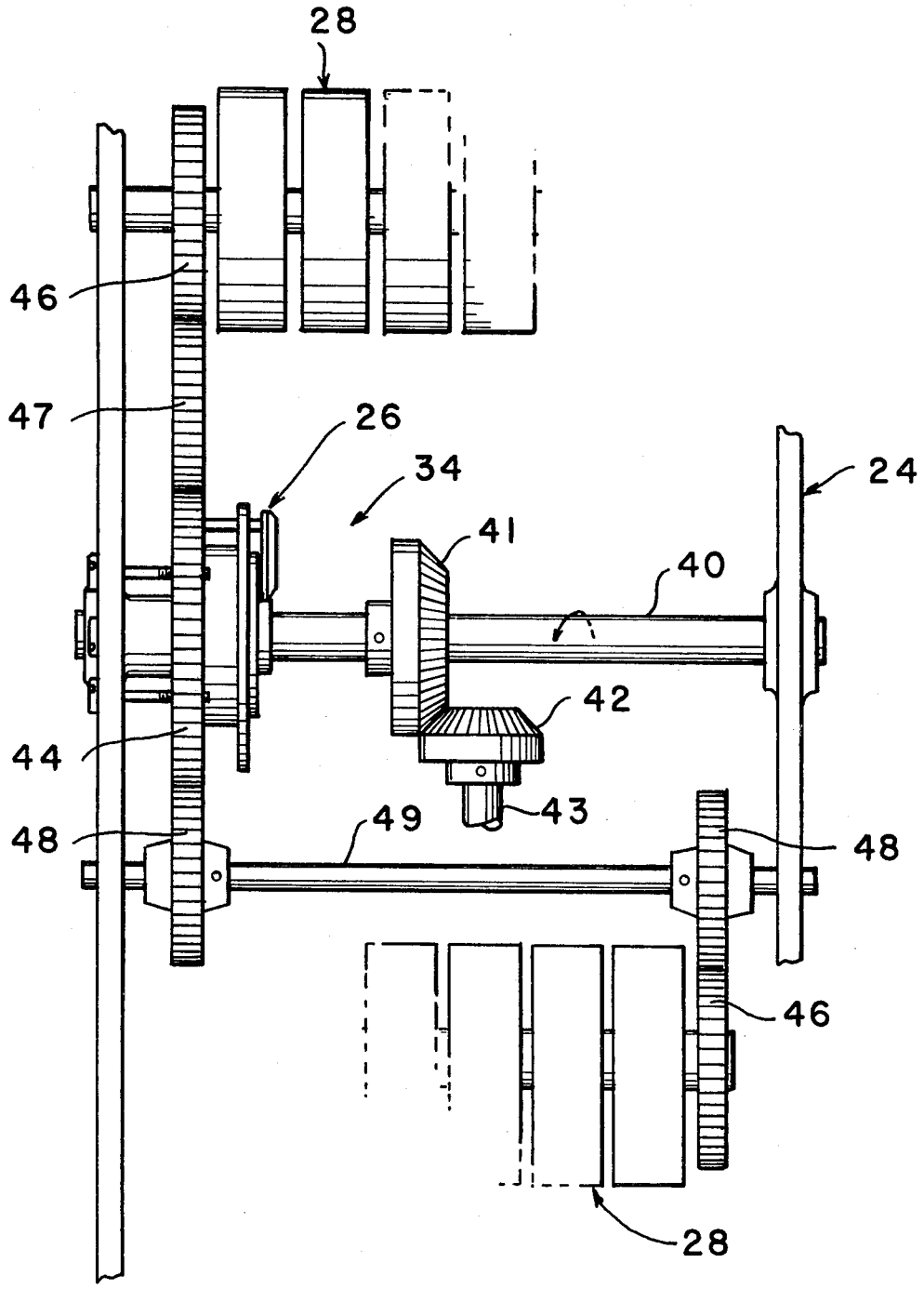
FIG. 1 is a generally diagrammatic view, partly broken away and partly in section, of a fuel delivery pump register incorporating a first embodiment of a rotary drive anti-overtravel device of the present invention.
Figure 2:
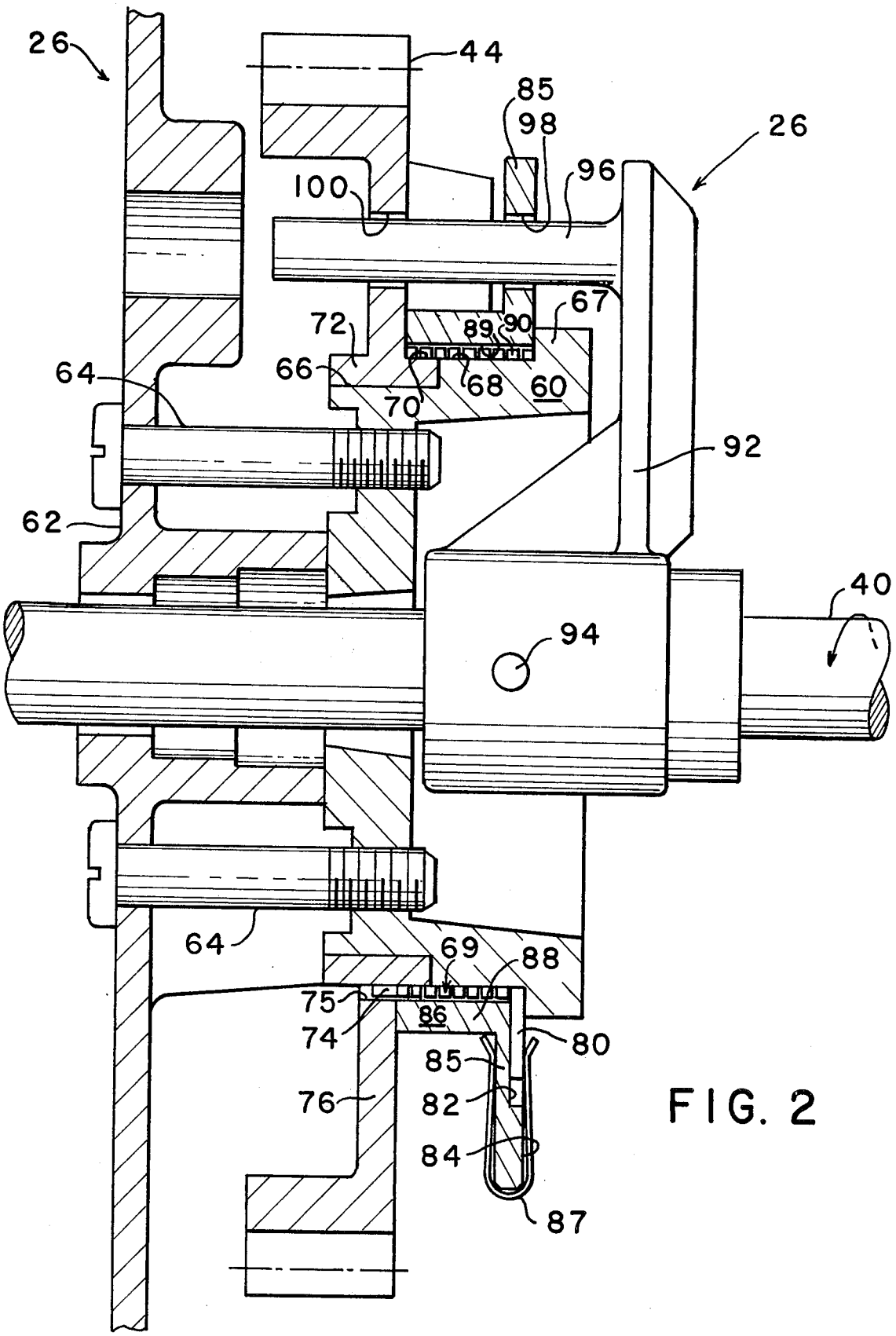
FIG. 2 is an enlarged partial transverse elevation section view, partly broken away and partly in section, of the register showing the rotary drive anti-overtravel device in greater detail.

Referring now to the drawings in detail wherein like reference numerals indicate like parts throughout, and referring particularly to FIGS. 1 and 2 a resettable fuel pump register 24 incorporating an embodiment 26 of a rotary drive anti-overtravel device of the present invention is shown having a pair of cost counters 28 for registering the cost amount of fuel dispensed. Except as described hereinafter, the resettable register 24 is like the register shown and described in the aforementioned U.S. Pat. No. 2,814,444 for example and is therefore not disclosed and described in detail herein.

A register drive train 34 to the cost counters 28 comprises a horizontal cross or center shaft 40 driven via suitable bevel gearing 41, 42 by a vertical cost shaft 43 which in turn is driven by a unit volume price variator (not shown) with which the register is associated in a conventional manner. A gear 44, mounted on the left end of the center shaft 40 as viewed in FIG. 1, is connected to drive the lowest order counter wheel gears 46 of both of the cost counters 28 via an idler gear 47 and a pair of similar gears 48 mounted on opposite ends of an idler shaft 49. The cost counter drive gear 44 is rotatably mounted on the center shaft 40 for being driven by the center shaft 40 via the anti-overtravel device 26 as described hereinafter. Thus, the two cost counters 28 are driven together via the anti-overtravel device 26 for registering the cost amount of fuel dispensed in accordance with the unit volume price setting of the variator (not shown) with which the register is associated. In the same manner, an identical volume counter anti-overtravel device (not shown) can be employed with a lower horizontal cross or center shaft (not shown) of the register for preventing inertia overtravel of a pair of volume counters (not shown) of the register.

The cost counters 28 (and the volume counters, not shown) are resettable between deliveries, and as will be seen upon reference to the aforementioned U.S. Pat. No. 2,814,444, the cost and volume counters are temporarily disengaged from their respective lowest order counter wheel drive gears 46 by the register reset mechanism during the register reset cycle.

The anti-overtravel device 26 comprises a fixed support ring 60 coaxial with the center shaft 40 and secured to a side frame 62 of the register 24 by a plurality of angularly spaced screw fasteners 64. The support ring 60 has a first reduced diameter cylindrical section 66 at its outer or left axial end as viewed in FIG. 2, providing a bearing for rotatably supporting the drive gear 44. The support ring 60 has a larger diameter radial end flange 67 at its opposite axial end and an intermediate diameter cylindrical section 68 between the bearing 66 and end flange 67 providing an external brake or friction drum.

A helical coil spring 69 is mounted on the cylindrical friction drum 68 and also on an abutting coaxial external cylindrical drum section 70 of the same diameter provided by an axially extending hub 72 of the drive gear 44. The helical coil spring 69 has an axially extending end tang 74 received within a hole 75 in a radial flange 76 of the cost counter drive gear 44. A radially extending tang 80 at the opposite end of the coil spring 69 is received within a wide recess or slot 82 in an axial end face 84 of a clutch operator 86. A U-shaped spring clip 87 is employed for locking the radial end tang 80 of the coil spring 69 to a radial end flange 85 of the clutch operator 86 and against angular displacement within the recess 82 of the end flange 85.

The clutch operator 86 has an inner annular hub or ring 88 which extends between the gear flange 76 and the support end flange 67 and so that an internal cylindrical drum 89 of the clutch operator hub 88 is generally concentric with and fully encloses a helical coil spring section 90 of the coil spring 69 intermediate the coil spring ends 74, 80. The helical coil spring section 90 has a plurality of helical friction coils which surround and which are in frictional engagement with the drum sections 68, 70 respectively. The helical coil spring section 90 has a normal or unstressed diameter slightly less than the common diameter of the coaxial abutting external drum sections 68, 70. Accordingly, the helical coil spring 69 frictionally engages each of the abutting drum sections 68, 70 to clutch the two drum sections 68, 70 together and thereby frictionally resists or brakes normal forward rotation of the drive gear 44, in the counter-clockwise direction as viewed from the right in FIG. 2. Also, the helical coil spring 69 is preferably formed of wire having a square cross section and so that adjacent coils are axially spaced slightly in the stressed or expanded condition of the coil spring 69 and each coil has a flat area of contact with the two external drum sections 68, 70 and also with the internal drum 89 of the clutch operator 86.

The clutch operator 86 is connected to be forwardly rotated by the center shaft 40, in the counter-clockwise direction as viewed from the right in FIG. 2, via a drive arm 92 secured to the center shaft 40 by a suitable set screw 94. The drive arm 92 has an integral axially extending post 96 received within a radial slot 98 in the radial end flange 85 of the clutch operator 86 and also in a circumferentially extending slot 100 in the radial flange 76 of the drive gear 44. The radial slot 98 in the clutch operator 86 is dimensioned to permit the clutch operator 86 to move or "float" radially slightly and yet to key the clutch operator 86 to the drive arm 92 without any angular play therebetween. In contrast, the circumferentially extending slot 100 in the drive gear 44 provides predetermined relative angular movement of the gear 44 and drive post 96 of for example about 15°. For example, the drive post 96 has a 0.125 inch diameter and the slot 100 has a 0.375 inch circumferential length to permit 0.250 inch displacement of the post 96 within the slot 100 (or about 16.4° angular displacement at a radius of 0.875 inch).

The clutch operator 86 is angularly mounted relative to the drive gear 44 so that the radial slot 98 in the clutch operator 86 is aligned with the trailing end of the circumferential slot 100 (i.e. the clockwise end as viewed from the right in FIG. 2) when the helical coil spring section 90 fully engages the drum sections 68, 70 as described to brake the gear 44 against forward angular rotation. For that purpose, the clutch operator 86 is first angularly positioned to achieve the desired orientation of parts without the clip 87 installed, and then the clip 87 is installed to affix the radial end tang 80 of the coil spring 69 to the clutch operator 86.

The coil spring 69 is coiled to extend helically from its clutch operator end 80 in the same angular direction as the direction of rotation of the center shaft 40, in the counter-clockwise direction as viewed from the in FIG. 2. Accordingly, the helical coil spring 69 is expanded out of frictional engagement with the brake drum section 68 by forward rotation of the clutch operator 86 relative to the drive gear 44. The inner diameter of the clutch operator hub 88 provides a slight clearance of for example about 0.025 inch for limited radial displacement or expansion of the helical coils of the coil spring and so that the clutch operator 86 rotates only about 2° to 3° relative to the gear 44 to expand the entire coil spring into engagement with the internal cylindrical drum of the hub 88 and thereby fully release the coil spring brake. Such limited relative angular movement is permitted by the circumferential slot 100 in the drive gear 44. The drive gear 44 is then positively driven by the clutch operator 86 via the helical coil spring 69. Upon discontinuance of rotation of the center shaft 40, the drive gear 44 is free to be rotated (by the momentum of the cost counters 28 and the very slight forward torsional bias of the coil spring 69) only an additional approximately 2° to 3° (to its original angular position relative to the clutch operator 86) where the drive gear 44 is braked against further rotation by the coil spring 69.

Thus, as long as the center shaft 40 is not rotating, the coil spring 69 locks the drive gear 44 to the fixed drum section 68 to prevent forward rotation of the drive gear 44. The brake provided by the coil spring 69 is fully released during a first predetermined small angular displacement of about 2° to 3° of the center shaft 40 and then the gear 44 is positively driven by the arm 92 and via the coil spring 69 during the remaining delivery of fluid.

Figure 3:
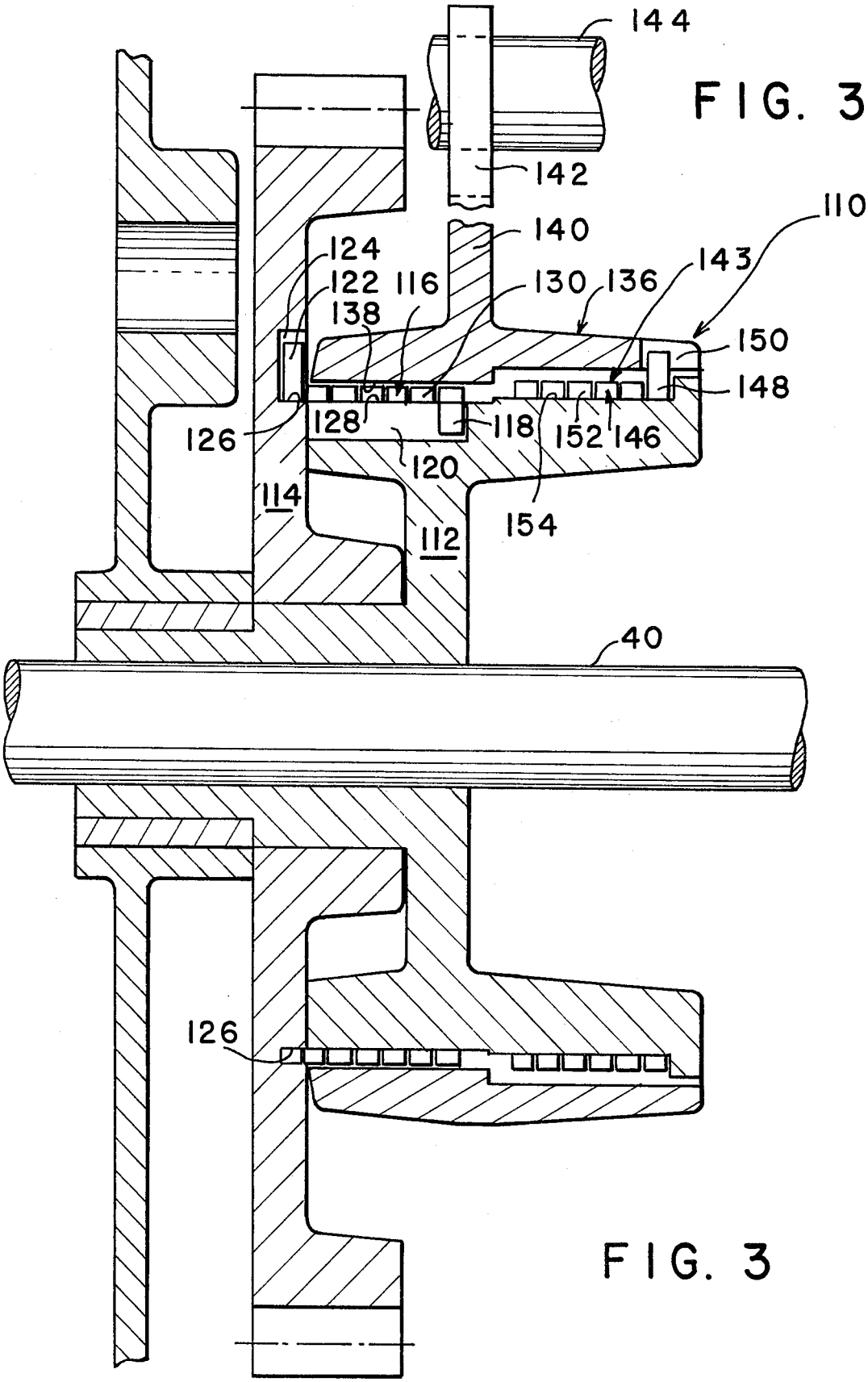
FIG. 3 is an enlarged partial transverse elevation section view, partly broken away and partly in section, of the register showing a second embodiment of a rotary drive anti-overtravel device of the present invention.

A second embodiment 110 of a rotary drive anti-overtravel device of the present invention is shown in FIG. 3. In that embodiment 110, a drive rotor 112 affixed to the center shaft 40 is connected to drive a cost counter drive gear 114 via a coil spring 116. One radially inwardly projecting end tang 118 of the coil spring 116 is received within an axial slot 120 in the drive rotor 112, and a second radially outwardly projecting end tang 122 of the coil spring is received within a radial slot 124 in the cost counter drive gear 114. The cost counter drive gear 114 has an annular slot providing an external annular drum section 126 and the drive rotor 112 has an external drum section 128 coaxial therewith. The two coaxial drum sections 126, 128 are normally engaged by an intermediate helical coil spring section 130 of the coil spring 116.

The helical coil spring section 130 has a plurality of helical friction coils normally in frictional engagement with the drum sections 126, 128 respectively. The helical coil spring section 130 has a normal or unstressed diameter slightly less than the common diameter of the coaxial abutting cylindrical drum sections 126, 128. Accordingly, the helical coil spring section 130 frictionally engages each of the abutting drum sections 126, 128 to clutch the two drum sections 126, 128 together for forwardly rotating the cost counter drive gear 114 with the drive rotor 112, in the counter-clockwise direction as viewed from the right in FIG. 3. Also, as in the embodiment of FIGS. 1 and 2, the coil spring 116 is preferably formed of wire having a square cross section and so that adjacent coils are axially spaced slightly in the stressed or expanded condition of the coil spring 116 in engagement with the drum sections 126, 128 and so that each coil has a flat area of contact therewith.

The coil spring 116 is coiled to extend helically from its drive rotor end 118 in the angular direction opposite to the direction of rotation of the center shaft 40. Accordingly, the helical coil spring 116 remains in engagement with the drum sections 126, 128 to positively forwardly rotate the cost counter drive gear 114 with the drive rotor 112.

A floating non-rotatable collar 136 is mounted coaxially with the drive rotor 112. The collar 136 has an internal cylindrical brake drum 138 concentric with and spaced from the helical coils of the coil spring 116. The floating collar 136 is fixed against rotation by a radial arm 140 having an outer bifurcated end 142 receiving a post 144 extending between the side frames of the register. The diameter of the internal brake drum 138 is established to provide a slight clearance of for example about 0.003 inch for expansion of the helical coils of the coil spring 116 and so that the drive gear 114 has to rotate forwardly less than about 2° relative to the drive rotor 112 to fully expand the coil spring 116 into engagement with the internal cylindrical drum 138 of the collar 136 and thereupon fully brake the gear 114 against further rotation. Thus, upon discontinuance of rotation of the center shaft 40, the drive gear 114 can be rotated, for example by the momentum of the cost counters 28, a maximum additional angle of 2° or less where the drive gear 114 is braked against further rotation by the coil spring 116.

Also, a friction brake 143 is provided between the drive rotor 112 and outer collar 136 to resist and thereby prevent forward rotation of the drive rotor 112 by the cost counters 28. Since such overtravel is transmitted upstream to the drive rotor 112 via a relatively light torsional bias of the coil spring 116, preferably only a relatively low frictional resistance, greater than the maximum possible torsional bias of the coil spring 116, is provided by the friction brake 143 to prevent cost counter overtravel of the drive rotor 112. With overtravel rotation of the drive rotor 112 sufficiently resisted by the friction brake 143, the coil spring 116, instead of forwardly rotating the drive rotor 112, will expand into engagement with the internal fixed drum 138 to brake the cost counter drive gear 114 against overtravel.

The friction brake 143 shown is provided by a second coil spring 146 having a radially outwardly extending end tang 148 received within a radial slot 150 in the collar 136 and a helical coil spring section 152 with a plurality of helical coils engaging an external cylindrical brake drum 154 of the drive rotor 112. The coil spring 146 is coiled to extend helically from its collar end 148 to its opposite free end in the opposite angular direction to the direction of rotation of the center shaft 40 so that the helical coil spring section 152 tends to be expanded out of frictional engagement with the brake drum 154 by forward rotation of the drive rotor 112, thereby to maintain a relatively constant frictional restraint on the drive rotor 112 during the delivery of fluid.

In each of the two described embodiments, the helical coil spring brake will prevent significant inertia overtravel of the cost counters 28 which might otherwise occur because of the normal "play" on backlash in the cost counter drive train, such inertia caused overtravel typically occurring when the fuel delivery is quickly terminated especially from a high delivery rate. In addition, the helical coil spring brake holds the rotary drive train 34 to the cost counters 28 in proper drive engagement and prevents forward rotary movement of the cost counters 28 when they are disengaged for being reset. Thus, after the counters are reset and upon the commencement of the following fuel delivery, the rotary drive train is substantially free of "play" in the driving direction.

As will be apparent to persons skilled in the art, various modifications, adaptations and variations of the foregoing specific disclosure can be made without departing from the teachings of the present invention.

We claim:

1. In a fluid delivery register comprising a rotary counter and a rotary drive train connected to rotate the counter for registering the amount of fluid delivered and having a rotary drive anti-overtravel device for preventing overtravel of the counter at the termination of a fluid delivery, the improvement wherein the rotary drive train comprises coaxial, relatively rotatable, rotary drive and driven members rotatable in one angular direction thereof during rotation of the counter to register the amount of fluid delivered and wherein the anti-overtravel device comprises a first fixed annular brake drum coaxial with the rotary drive and driven members, and a coil spring having first and second ends connected to said rotary drive and driven members respectively and an intermediate helical coil spring section mounted for coaxial frictional engagement with the annular brake drum and extending generally helically in an angular direction tending to increase the said frictional engagement with the annular brake drum upon rotation of the driven member in said one angular direction relative to the drive member, the drive member positively rotating the driven member in said one angular direction in first relative angular positions thereof and the helical coil spring engaging the brake drum to brake the driven member against rotation in said one angular direction in second relative angular positions of the drive and driven members having a predetermined limited relative angular displacement of the driven member in said one angular direction relative to the drive member from their said first relative angular positions.

2. In a fluid delivery register comprising a rotary counter and a rotary drive train connected to rotate the counter for registering the amount of fluid delivered and having a rotary drive anti-overtravel device for preventing inertia overtravel of the counter at the termination of a fluid delivery, the improvement wherein the rotary drive train comprises coaxial, relatively rotatable, rotary drive and driven members rotatable in one angular direction thereof during rotation of the counter to register the amount of fluid delivered and wherein the anti-overtravel device comprises control means including selectively operable brake means for selectively braking the driven member against rotation in said one angular direction with the drive and driven members in first relative angular positions thereof and releasable by predetermined limited angular displacement of the drive member in said one angular direction relative to the driven member from their said first relative angular positions, the control means being operable, after said predetermined limited relative angular displacement of the drive member for positively rotating the driven member in said one angular direction.

3. A fluid delivery register according to claim 2 wherein the selectively operable brake means comprises a first annular brake drum coaxial with the rotary drive and driven members and a coil spring with a helical coil spring section mounted for coaxial frictional engagement with the annular brake drum for braking the driven member against rotation in said one angular direction and selectively operable by said predetermined limited relative angular displacement of the rotary members for selectively braking and releasing the driven member.

4. A fluid delivery register according to claim 1 or 3 wherein the helical coil spring section is formed by a plurality of continuous helical coils.

5. A fluid delivery register according to claim 1, 2 or 3 wherein the said predetermined limited relative angular displacement of the drive and driven members is no greater than 3°.

6. A fluid delivery register according to claim 1 or 3 wherein one of the rotary members has an annular control drum in opposed spaced concentric relationship with the annular brake drum for limiting radial displacement of the helical coil spring section from the brake drum by the said relative angular displacement of the drive and driven members.

7. In a rotary drive train having coaxial rotary drive and driven interconnected members for rotating the rotary driven member in one angular direction thereof by rotation of the rotary drive member in the same angular direction, the rotary drive and driven members having predetermined limited relative rotation thereof between first and second relative angular positions thereof, and rotary drive anti-overtravel means for preventing angular overtravel of the driven member in said one angular direction, the rotary drive anti-overtravel means comprising a first fixed annular brake drum coaxial with the rotary drive and driven members, a coil spring having a first end connected to the driven member, a second end, and an intermediate helical coil spring section having a plurality of coaxial coils mounted for coaxial frictional engagement with the said annular brake drum, the helical coil spring section extending generally helically in an angular direction tending to decrease its frictional engagement with the said annular brake drum upon rotation of said drive member in said one angular direction relative to said driven member, the drive member being connected to rotate the said second end of the coil spring in said one angular direction to disengage the helical coil spring section from the brake drum to release the driven member for rotation by the drive member in said one angular direction.

8. A rotary drive train according to claim 7, wherein the rotary driven member has a second coaxial annular drum, and wherein the helical coil spring section is in coaxial engagement with the said second annular drum.

9. A rotary drive train according to claim 7 wherein the drive member has a control drum in opposed spaced concentric relationship with the brake drum for limiting radial displacement of the helical coil spring section from the brake drum by the said rotation of the second end of the coil spring in said one angular direction by the rotary drive member.

10. A rotary drive train according to claim 9 wherein the fixed brake drum is an internal drum and the control drum is an external drum.

11. A rotary drive train according to claim 9 wherein the fixed brake drum is an external drum and the control drum is an internal drum.

12. A rotary drive train according to claim 7, 8, 9, 10 or 11, further comprising means for resisting rotation of the drive member in said one angular direction to prevent angular overtravel thereof.

13. A rotary drive train according to claim 12 wherein the resisting means comprises a second brake drum and a second helical coil spring section in frictional engagement with the second brake drum.

* * * * *